US005503730A

United States Patent [19]

Osano et al.

[11] Patent Number: 5,503,730

[45] Date of Patent: Apr. 2, 1996

[54] METHOD FOR ANODIC OXIDATION

[75] Inventors: Nagato Osano, Kawasaki; Hirofumi Miyaki, Toride; Shiro Higashikozono, Tsukuba, all of Japan

[73] Assignee: Canon Kabushiki Kaisha, Tokyo, Japan

[21] Appl. No.: 407,049

[22] Filed: Mar. 17, 1995

Related U.S. Application Data

[63] Continuation of Ser. No. 912,529, Jul. 13, 1992, abandoned.

[30] Foreign Application Priority Data

Jul. 16, 1991 [JP] Japan ..... 3-175517
Jul. 16, 1991 [JP] Japan ..... 3-175518

[51] Int. Cl.[6] ..... C25D 11/02; C25D 21/12

[52] U.S. Cl. ..... 205/83; 205/116; 205/145

[58] Field of Search ..... 205/81, 82, 83, 205/84, 116, 128, 145; 204/228, 297 R

[56] References Cited

U.S. PATENT DOCUMENTS 4,192,729 3/1980 Cancelleri et al. ..... 204/272
4,545,876 10/1985 McGivern, Jr. ..... 204/130

FOREIGN PATENT DOCUMENTS 0093921 4/1983 European Pat. Off. .
0468502 7/1991 European Pat. Off. .
58-184903 10/1983 Japan .
62-84536 4/1987 Japan ..... 205/81
62-36219 8/1987 Japan .

OTHER PUBLICATIONS

Patent Abstracts of Japan, vol. 8, No. 119, Oct. 5, 1984 (JP-A-59 101 603).
Patent Abstracts of Japan, vol. 12, No. 181, May 27, 1988 (JP-A-62 287 098).

*Primary Examiner*—John Niebling
*Assistant Examiner*—William T. Leader
*Attorney, Agent, or Firm*—Fitzpatrick, Cella, Harper & Scinto

[57] ABSTRACT

Disclosed are a method and an apparatus for forming a specular protective film in which the intensity of reflected light is made even with a variation in the angle of incidence of the incident light. In the anodic oxidation treatment, the current value applied to a plurality of specular parts is sampled at a predetermined interval (S301), and each sampled value is integrated over time (S302) and the average value is obtained. A comparison is made between an obtained average value and a preset value, and if the average value is greater, the application of current to all the specular parts is stopped (S303). The preset value is the amount of electricity conducted to form an anodic oxide film having a film thickness corresponding to a desired reflectance which is determined from the relation between the preset film thickness of anodic oxide film and the reflectance. Also, a process for checking to see whether or not the voltage produced by applying the current to each specular part at the start of anodic oxidation treatment is at a predetermined rise slope (S304 to S310), and a process for correcting the current applied to each specular part so as to be equal to the average value during the anodic oxidation treatment are provided (S311 to S315).

4 Claims, 6 Drawing Sheets

METHOD FOR ANODIC OXIDATION

This application is a continuation of application Ser. No. 07/912,529 filed Jul. 13, 1992, now abandoned.

BACKGROUND OF THE INVENTION

1. Field of the Invention

The present invention relates to a method for forming a specular protective film.

2. Related Background Art

It is common practice to use a rotary polygon mirror for polarizing a light beam in a laser scanning optical system for use with a laser printer or a laser copying machine, as described in Japanese Patent Publication No. 62-36219.

Such a rotary polygon mirror is generally made of aluminum alloy, plastics, or glass, with its reflecting surface (specular surface) having a transparent intense reflecting film (protective film) applied thereon.

When the reflecting surface is an aluminum specular surface, an anodic oxide film has been applied as a protective film. In this case, it can function well because of having a good adherence to a substratum of aluminum alloy.

When an anodic oxide film is formed in such a transparent single layer film to serve as a protective layer of the specular surface such that the intensity of reflected light may be maximum, the optical film thickness is $m \cdot /2\cos\theta$ ($\lambda$: wavelength of incident light, $\theta$: angle of incidence, m: positive integer) and the angle of incidence is at a center of scan range, as described in Japanese Laid-Open Patent Application No. 58-184903.

However, in the conventional art as above described, when a specular part is formed of aluminum alloy, the refractive index $n_0$ as a mirror can be represented as $$n_0 = n_2 - i \cdot k$$

(k: extinction coefficient, $i = \sqrt{-1}$)

where $n_2$ is a refractive index of the aluminum alloy. Here, $n_0$ is a complex refractive index, but when the angle of incidence is at a center of the scan range for light incident on the specular protective film, the intensity of reflected light is set to be maximum, without regard to the complex refractive index $n_0$. Thus, the conventional art has a problem that there is a large difference between intensities of reflected lights from the central portion of the scan range and its peripheral portion, when the incident angle changes, so that it can not be used practically.

SUMMARY OF THE INVENTION

In view of the above-mentioned problem associated with the conventional art, an object of the present invention is to provide a method for forming a specular protective film with which the intensity of reflected light is made optimal even when the incident angle of the light changes.

According to the present invention, there is provided a method for forming a specular protective film in which a specular part made of metal is treated with anodic oxidation, characterized by forming an anodic oxide film on the specular part having a film thickness corresponding to a desired reflectance by controlling the cumulative charge at the anodic oxidation treatment.

The above-described method for forming the specular protective film has four cases in which the anodic oxidation is applied to a plurality of specular parts at the same time, in which the current value applied to a plurality of specular parts is sampled at a predetermined intervals and its average value is obtained, whereby the current value is controlled to be equal to the average value obtained, in which the anode for use with the anodic oxidation is pressed against the specular part to make contact therewith, while being electrochemically shielded from the cathode, and in which the specular part is a polygon reflecting mirror having a plurality of specular faces.

In the method for forming the specular protective film according to the present invention, since the specular protective film is formed by anodic oxidation, its film thickness can be controlled by the cumulative charge at the anodic oxidation treatment, i.e., the applied voltage between the electrodes and its application time. Therefore, by determining the film thickness corresponding to a desired reflectance from the relation between a premeasured film thickness of anodic oxide-film and the reflectance and performing the anodic oxidation in accordance with the film thickness obtained, a specular protective film having the desired reflectance can be formed.

Also, the conventional art has a problem that since the oxidation process is performed in a state where a workpiece is hooked or pinched to an anode jig, the workpiece may be dropped or improper contact of the workpiece with the anode jig may be caused in immersing or extracting it in or out of electrolyte, resulting in a lower work efficiency.

Also, it has an additional problem that as the anode jig is oxidized along with the workpiece, the reproduction process, i.e., the operation of removing the oxide film formed on the specular surface of the anode jig, must be performed in using the anode jig consecutively, resulting in a reduced number of uses.

A second object of the present invention is, in view of the above-mentioned problems associated with the conventional art, to provide a method and an apparatus for anodic oxidation treatment which allows the improvement in the operation efficiency and the cost reduction.

In a second invention, there is provided a method for anodic oxidation treatment to form an anodic oxide film on a workpiece by immersing the workpiece in electrical contact with an anode into an electrolyte, along with the anode and a cathode, and allowing current to flow between the anode and the cathode, characterized in that the anode is electrochemically shielded from the cathode, and is pressed against the workpiece to make contact therewith, in which the workpiece is either a polygon reflecting mirror having a plurality of specular surfaces, or formed of aluminum.

The present invention provides an apparatus for anodic oxidation treatment for forming an anodic oxide film on a workpiece, comprising an anode in electrical contact with the workpiece and a power unit for allowing current to flow between the anode and the cathode, by immersing the workpiece into an electrolyte along with the anode and the cathode, characterized by electrode pressing means for pressing the anode against the workpiece to make contact therewith, and an electrode shield member for electrochemically shielding the anode from the cathode.

In such an apparatus for anodic oxidation treatment, the anode is a columnar body, a cylindrical electrode support member for supporting the anode is inserted into a cylindrical electrode shield member so as to be slidable in a predetermined width, the electrode support member is secured into an electrode mounting hole formed on an electrode support base, the anode is inserted into the electrode support member so as to be slidable in a predetermined width, and electrode pressing means formed of a spring material is interposed between the anode and the electrode support base to always bias the anode in an opposite direction to the electrode support base, wherein there are some cases such as:

a shield pressing spring is interposed between the electrode shield member and the electrode support base to always bias the electrode shield member in an opposite direction to the electrode support base, the workpiece is a polygon reflecting mirror having a plurality of specular surfaces, and the workpiece is formed of aluminum.

DESCRIPTION OF THE PREFERRED EMBODIMENTS

The first embodiment of the present invention will be described below with reference to the drawings.

Figure 1:
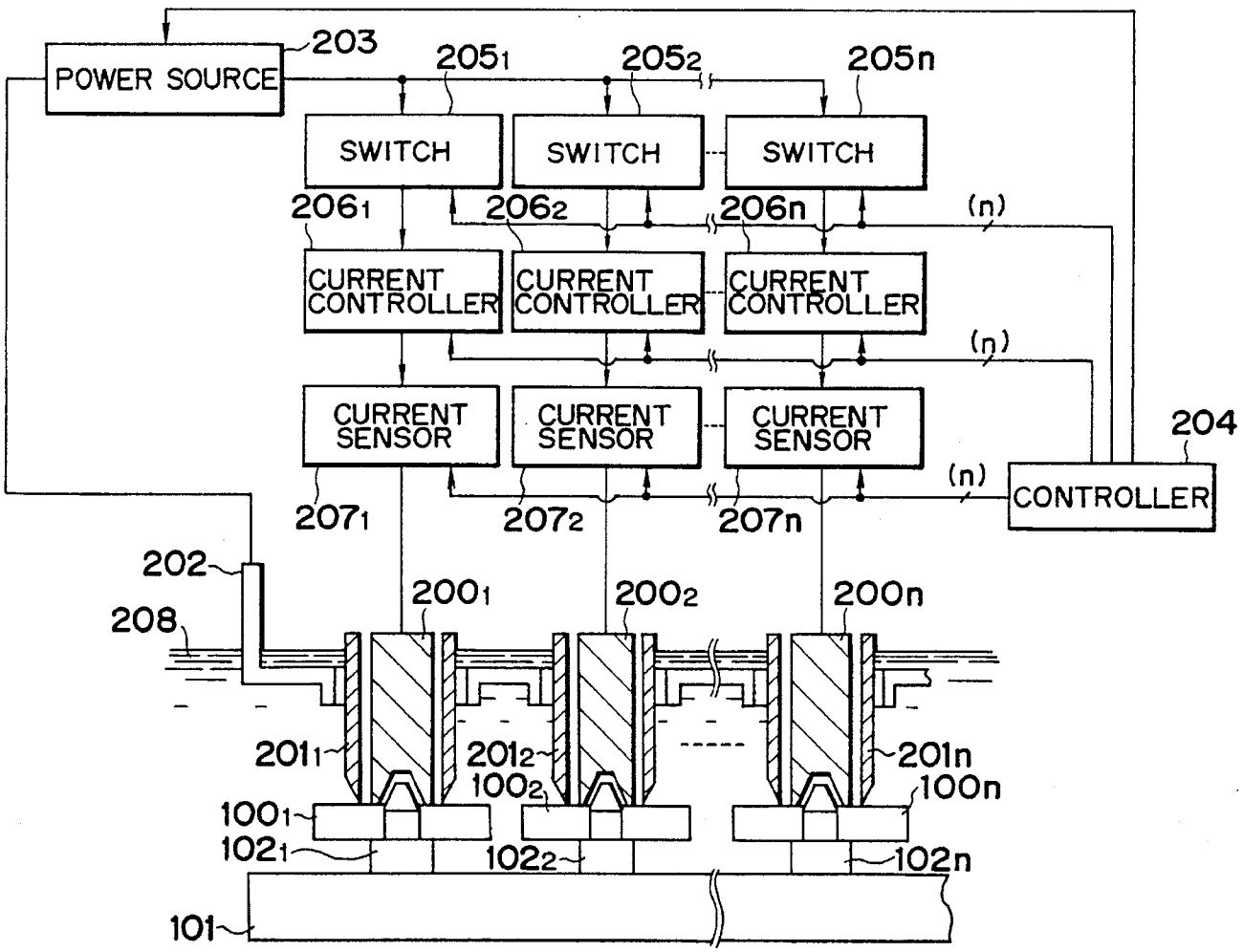
FIG. 1 is a block diagram illustrating an apparatus for anodic oxidation treatment to carry out a method for forming a specular protective film according to an embodiment of the present invention.

FIG. 1 is a block diagram illustrating an example of an apparatus for anodic oxidation treatment to carry out a method for forming a specular protective film according to the present invention.

The apparatus for anodic oxidation treatment in this embodiment comprises a plurality of anodes $\mathbf{200}_1$ to $\mathbf{200}_n$, a cathode 202 for the anodes $\mathbf{200}_1$ to $\mathbf{200}_n$, and a power source 203 for supplying the electricity between the anodes $\mathbf{200}_1$ to $\mathbf{200}_n$ and the cathode 202, wherein the anodic oxidation process is performed by immersing the anodes $\mathbf{200}_1$ to $\mathbf{200}_n$ in contact with a plurality of workpieces $\mathbf{100}_1$ to $\mathbf{100}_n$ into an electrolyte, along with the cathode 202.

Figure 2:
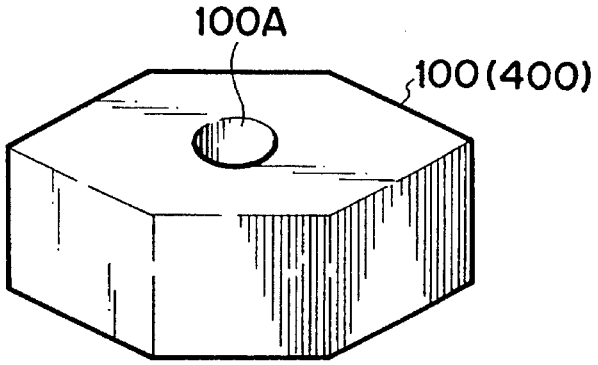
FIG. 2 is a perspective view exemplifying a workpiece.

The workpieces $\mathbf{100}_1$ to $\mathbf{100}_n$ in this embodiment are polygonal reflecting mirrors shaped as hexagonal prisms, made of aluminum alloy, to polarize a laser beam for use with a laser printer or a laser copying machine, as shown in FIG. 2, in which the anodic oxide film is formed as a specular protective film by the apparatus for anodic oxidation treatment. The workpieces $\mathbf{100}_1$ to $\mathbf{100}_n$ are mounted on a workpiece support base 101 by inserting workpiece support members $\mathbf{102}_1$ to $\mathbf{102}_n$ which protrude on the workpiece support base at a predetermined spacing into each mounting hole 100A.

In the apparatus for anodic oxidation treatment, the anodes $\mathbf{200}_1$ to $\mathbf{200}_n$ are connected to the power source 203 via respective switches $\mathbf{205}_1$ to $\mathbf{205}_n$ for stopping the electrical conduction current controllers $\mathbf{206}_1$ to $\mathbf{206}_n$ consisting of variable resistors to limit the current flowing therethrough upon current-carrying, and current sensors $\mathbf{207}_1$ to $\mathbf{207}_n$ for sensing the amount of current flowing therethrough upon current-carrying.

The power source 203 is controlled with an instruction from a controller as will be described later.

The switches $\mathbf{205}_1$ to $\mathbf{205}_n$ each are normally in an open state, and switched to open or close independently by the controller 204, when the anodic oxidation treatment is started, i.e., when the electric current is initially carried between the anodes $\mathbf{200}_1$ to $\mathbf{200}_n$ and the cathode 202, and when the anodic oxidation treatment is terminated.

The current controllers $\mathbf{206}_1$ to $\mathbf{206}_n$ consist of variable resistors, as previously described, with each resistance separately changed by the controller 204, whereby the electric current flowing between the anodes $\mathbf{200}_1$ to $\mathbf{200}_n$ and the cathode 202 is controlled.

The current sensors $\mathbf{207}_1$ to $\mathbf{207}_n$ sense the value of the current flowing through the switches $\mathbf{205}_1$ to $\mathbf{205}_n$ and the current controllers $\mathbf{206}_1$ to $\mathbf{206}_n$ to the anodes $\mathbf{200}_1$ to $\mathbf{200}_n$, in which the sensed current value is transmitted to the controller 204.

The anodes $\mathbf{200}_1$ to $\mathbf{200}_n$, each of which is columnar, are inserted into the cylindrical electrode shield members $\mathbf{201}_1$ to $\mathbf{201}_n$ made of a rubber to shield electrochemically the anodes $\mathbf{200}_1$ to $\mathbf{200}_n$ from the cathode 202. Further, each of the anodes $\mathbf{200}_1$ to $\mathbf{200}_n$ is provided with electrode pressing means (not shown) comprising a spring for biasing the anode $\mathbf{200}_1$ to $\mathbf{200}_n$ downward in its axial direction, whereby each anode $\mathbf{200}_1$ to $\mathbf{200}_n$ is pressed against each workpiece $\mathbf{100}_1$ to $\mathbf{100}_n$ by the electrode pressing means to make contact therewith in the anodic oxidation treatment. At a bottom end portion of the anode $\mathbf{200}_1$ to $\mathbf{200}_n$ is formed a recess portion into which the work support member $\mathbf{102}_1$ to $\mathbf{102}_n$ which protrude from the workpiece support base 101 is fitted, whereby each of the anodes $\mathbf{200}_1$ to $\mathbf{200}_n$ is placed into contact with the workpiece $\mathbf{100}_1$ to $\mathbf{100}_n$ on the periphery of the recess portion. In this state, the anodic oxidation treatment is carried out by immersing the workpieces $\mathbf{100}_1$ to $\mathbf{100}_n$ into an electrolyte, along with the anodes $\mathbf{200}_1$ to $\mathbf{200}_n$ and the cathode 202.

The setting of film thickness for the anodic oxide film in this embodiment will be now described with reference to FIG. 3.

Figure 3:
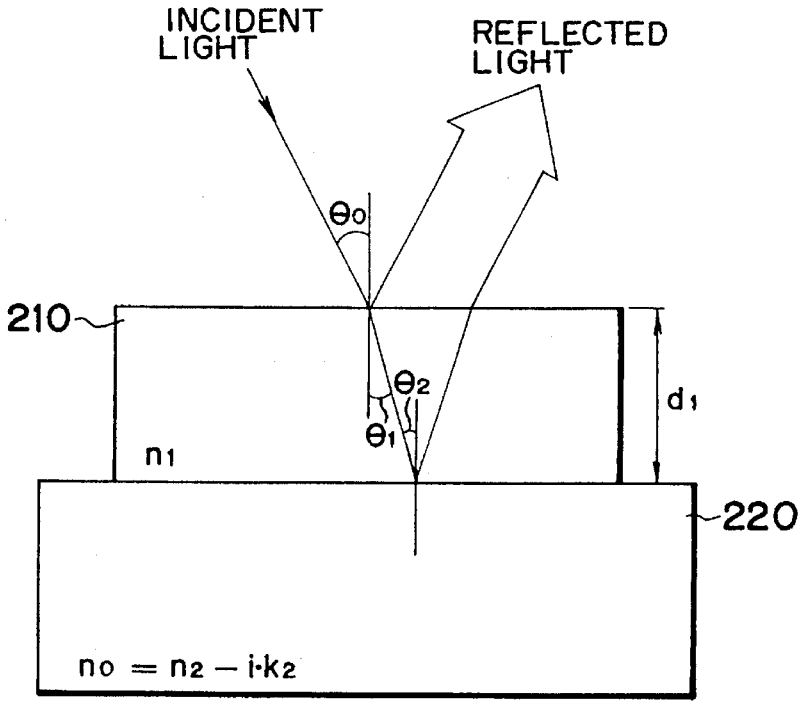
FIG. 3 is a view exemplifying the reflected light at a transparent single layer film formed on a metallic layer.

FIG. 3 is a side view illustrating a transparent single layer 210 formed on a metallic layer 220 made of aluminum alloy which is machined to obtain the specular surface.

In FIG. 3, the metallic layer 220 has a complex refractive index:

$$n_0 = n_2 - i \cdot k_2$$

($n_2$: a refractive index of aluminum, $k_2$: an extinction coefficient of aluminum alloy)

When the transparent single layer film 210 of aluminum oxide film having a refractive index $n_1$ is formed on the metallic layer 220, the angles of refraction $\theta_1$, $\theta_2$ for the transparent single layer film 210 and the metallic layer 220 can be represented by the following expressions, assuming that light is incident from a medium of incidence (air) at an angle of incidence $\theta$:

$$\theta_1 = \sin^{-1}\{n_0 \cdot \sin\theta_0 / n_1\}$$

$$\theta_2=\sin^{-1}\{n_0\cdot\sin\theta_0/(n_2-i\cdot k_2)\}$$

$\theta_2$ is a complex number because of $i=\sqrt{-1}$, so that the above expressions can be rewritten as follows:

$$\theta_2=\alpha-\beta\cdot i$$

Now assuming that the S polarized light beam is used, and if the Fresnel number of S polarized light component of reflected light at the interface between the medium of incidence and the transparent single layer film 210 is $r_{0s}$, the following expression is given:

$$\Gamma_{0s}=-\{\sin(\theta_0-\theta_1)\}/\{\sin(\theta_0+\theta_1)\}$$

Further, if the Fresnel number of S polarized light component of reflected light at the interface between transparent single layer film 210 and metallic layer 220 is $r_{1s}$, the following expression is given:

$$\Gamma_{1s}=-\sin\{(\theta_1-\alpha)-\beta\cdot i\}/\sin\{(\theta_1+\alpha)+i\}$$

As $r_{0s}$ is a real number, $$\Gamma_{0s}=r_{0s}$$

and as $r_{1s}$ is a complex number, $$\Gamma_{1s}=r_{1s}\cdot e^{\phi 1s}$$

Where $r_{1s}$ is magnitude of an amplitude, and $\phi_{1s}$ is a phase.

If the geometrical film thickness of the transparent single layer film 210 is $d_1$, the phase delay $\psi_1$ caused when the light having a wavelength $\lambda$ proceeds and then returns through the transparent single layer film 210 can be expressed as:

$$\psi_1=4\cdot\pi\cdot n_1\cdot d_1\cdot\cos\theta_1/\lambda$$

Accordingly, the S polarized light component $\Gamma_s$ of mixed amplitude reflectance, which is produced by the interference of the reflected light $\Gamma_{0s}$ at interface between medium of incidence and transparent single layer film 210, and the reflected light $\Gamma_{1s}$ at interface between transparent single layer film 210 and metallic layer 220, can be expressed as:

$$\Gamma_s=\{r_{0s}+r_{1s}\cdot e^{i\cdot(\phi 1s-\phi 1)}\}/\{1+r_{0s}\cdot r_s\cdot e^{i\cdot(\phi 1s-\phi 1)}$$
$$=r_s\cdot e^{i\cdot\delta s}$$

Where $r_s$ is an amplitude of $\Gamma_s$, and $\delta_s$ is a phase of $\Gamma_s$.

As established by the above expression, if the angle of incidence $\theta$, the wavelength of light $\lambda$, the refractive index $n_1$ of transparent single layer film 210 and the refractive index $n_0$ of metallic layer 220, and the extinction coefficient k are determined, the reflectance of S polarized light component can be determined uniquely with relation to the film thickness of transparent single layer film 210, and further the reflectance can be controlled precisely.

Therefore, in this embodiment, the anodic oxide film corresponding to the transparent electrode layer 210 is preformed, and the reflectance of specular part (workpiece) is premeasured with its film thickness, after which the film thickness corresponding to a desired reflectance is determined.

Since in the anodic oxidation treatment, the anodic oxide film to be formed has the film thickness which can be controlled by the amount of electricity conducted between anode and cathode electrodes, i.e., the applied voltage and its application time, a specular protective film securing a desired reflectance can be formed by performing the anodic oxidation treatment with the amount of conducting electricity corresponding to a determined film thickness as above described.

Figure 4:
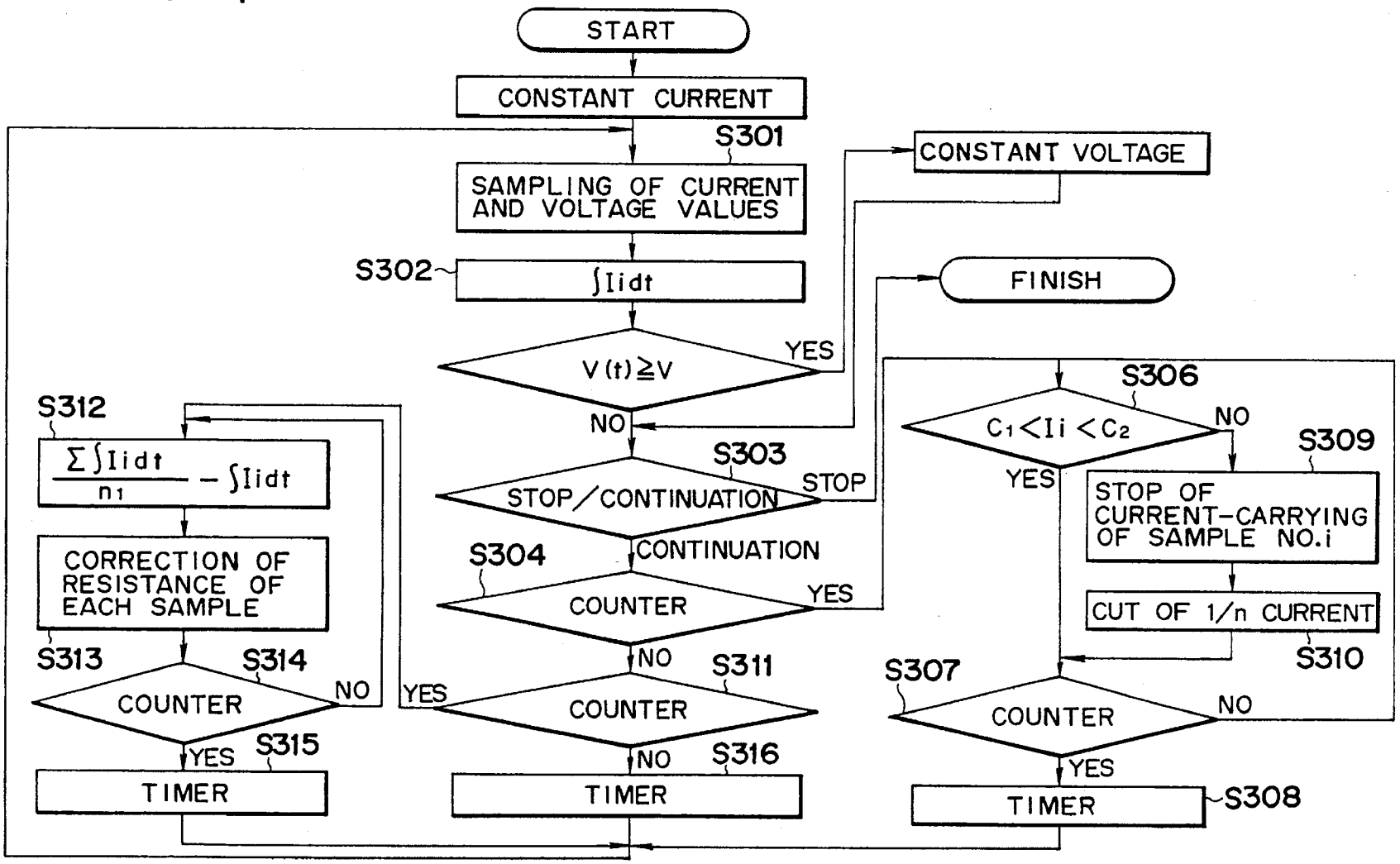
FIG. 4 is a flowchart exemplifying the control operation for the amount of electricity conducted in the method for forming a specular protective film.

Now, the control for the amount of conducting electricity in the anodic oxidation treatment in this embodiment will be described in connection with a flowchart showing the operation of a controller 204 as shown in FIG. 4.

First, charge is generated between anodes $\mathbf{200}_1$ to $\mathbf{200}_n$ and cathode 202, based on the amount of cumulative charge corresponding to a film thickness of anodic oxide film determined as previously described.

In this embodiment, supposing that the set average value for the cumulative charge is 3.2 A·sec, a constant current is applied for a predetermined period.

Thereafter each current value $I_i(t)$ (i=1, 2, . . . , n) and V(t), the voltage from power source 203 commonly applied between all anodes $\mathbf{200}_1$, $\mathbf{200}_2$, . . . , $\mathbf{200}_n$ and the common cathode 202 sensed by the current sensors $\mathbf{207}_1$ to $\mathbf{207}_n$ are sampled at a sampling interval $\Delta t$ (dt) (S301). When V(t) exceeds a set voltage, the voltage to all the anodes is changed to apply constant voltage. Those n current values $I_i(t)$ are integrated, i.e., $\int I_i(t)dt$ (S302). The average value of the integrated values is calculated and compared with the set value (3.2 A·sec) (S303), in which if the average value $\Sigma\int I_i(t)dt/n_1$ exceeds the set value, the current to all the electrodes is stopped.

Figure 5:
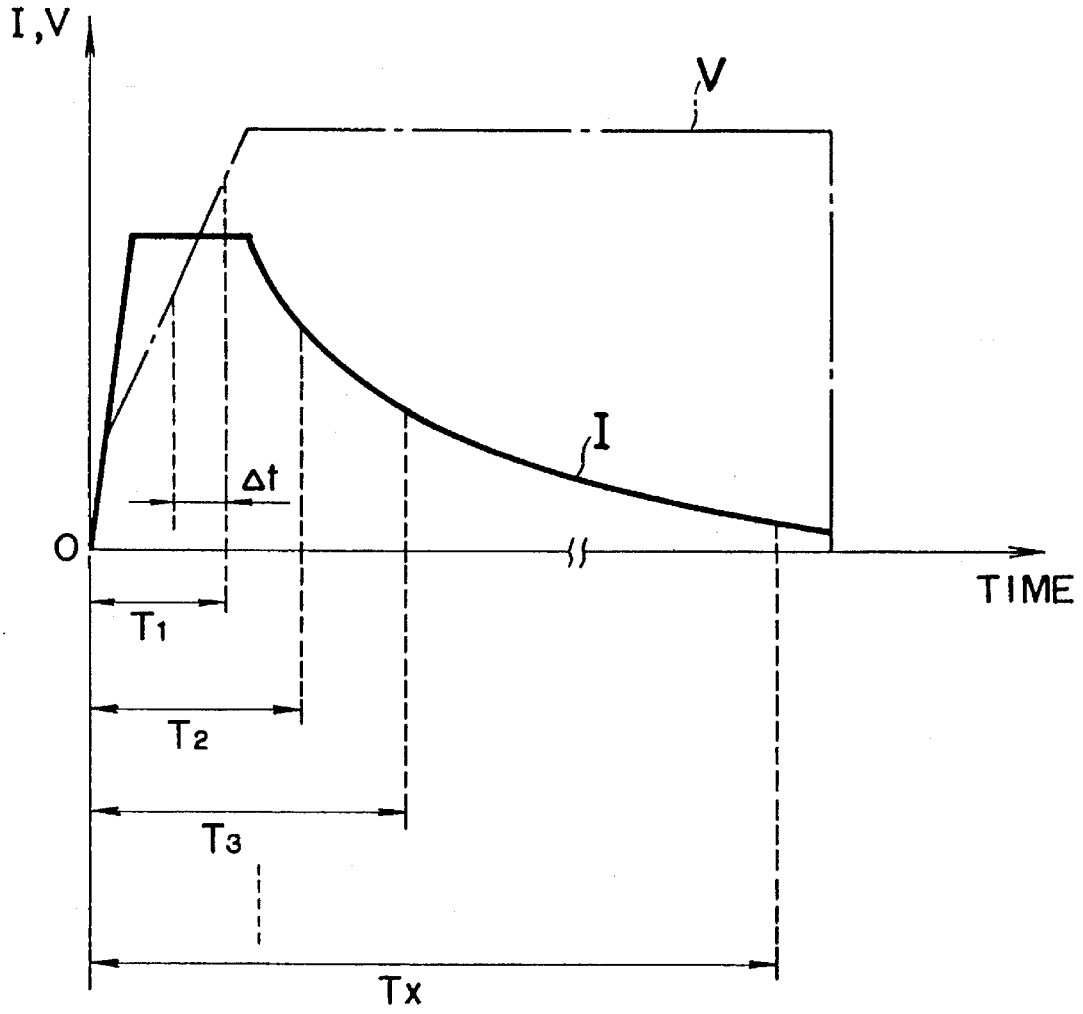
FIG. 5 is a graph representation typically showing the variation between applied current and interelectrode voltage at the anodic oxidation treatment.

In the comparison between the average value and the set value at S303, if the average value does not exceed the set value, the time $T_1$ for observing the current $I_i$ flowing between each of the anodes $\mathbf{200}_1$ to $\mathbf{200}_n$ and the cathode 202 is set, as shown in FIG. 5. This time $T_1$, during the constant current period, is a function of the sampling interval $\Delta t\times$number of samples and a check is made to determine whether or not the time $T_1$ is reached (S304). If the time $T_1$ is reached, a check is made to determine whether or not each sampling current $I_i$ falls within a predetermined acceptable tolerance (lower limit: C1, upper limit: C2) (S306). This operation is repeated for all the samples (S307). If any obtained current $I_i$ falls out of the tolerance, the current-carrying to the corresponding sample or anode $\mathbf{200}_i$ is stopped by turning the switch $\mathbf{205}_i$ corresponding to the anode $\mathbf{200}_i$ into the open state (S309). Further, if the current to a certain anode is stopped, the initial current value is cut by 1/n (S310), because the amount of current to the other anodes, i.e. anodes in electric conduction, will increase.

If the operation of step S307 is finished for all the samples, step S308 is performed and the steps S301 to S303 are repeated to compare the average value of sampled charge and the set value (3.2 A·sec). Then, if there is any anode in which the current-carrying is stopped, that anode is excluded from the charge value sampling, and thus the number of samples in electric conduction is supposed to be $n_1$. Thereafter, the elapse of the time $T_1$ is checked again at S304. Here, as the time which occurs only when the time equals $T_1$ has been previously detected as elapsed, the operation proceeds to S311.

At step S311, the timing (time $T_2$, $T_3$, . . . , $T_x$ where $T_1<T_2<T_3<\ldots<T_x$) as shown in FIG. 5 is set to correct each current value sampled at S301, and a check is made to determine whether or not the time $T_2$, $T_3$, . . . , $T_x$ occurs. The correction is performed in steps S312 to S314. At step S311, if the time $T_2$, $T_3$, . . . , $T_x$ is not occurring, the operation of S301 to S304 is repeated until the time $T_2$, $T_3$, . . . , $T_x$ occurs. Step 316 is performed before each repetition. Meanwhile, the current value is consecutively sampled at an interval $\Delta t$.

Thereafter, if the time $T_2$, $T_3$, . . . , $T_x$ occurs, the correcting operation for the current value is started.

First the summation $\Sigma\int I_i dt$ of time integrations $\int I_i dt$ for the sampled current values is obtained and divided by the number of samples to obtain the average value of the current with time integration $\Sigma\int I_i dt/n_1$. And, the difference between the obtained average value and integrated sampled current value $\Sigma\int I_i dt/n_1-\int I_i dt$ is obtained (S312). The current controller $\mathbf{206}_i$ corresponding to each sample or anode $\mathbf{200}_i$ is driven by the controller 204 based on the difference obtained according to the samplings of the sensors $\mathbf{207}_1$–$\mathbf{207}_n$, and is controlled so that the sampled current value may correspond to the average value of the current with time integration (S313). The correction for the current value is made for all the samples (S314), after which the steps S301 to S304 are repeated after performing step S315 until the next timing $T_2, T_3, \ldots, T_x$ has elapsed.

Note that the timers as shown at steps S308, S315 and S316 in FIG. 4 are directed to control of timing an operation of applying current $I_i$ (S308), control of timing an operation of the correction for the current value (S315), and control of timing an operation for adjusting the sampling interval so that the timing of sampling the current value may be always at a constant interval (S316).

The anodic oxidation treatment is performed while controlling the current as above described, and when the cumulative charge reaches a predetermined amount, the charge is stopped as the anodic oxide film as a specular protective film has been formed having a desired thickness.

Figure 6:
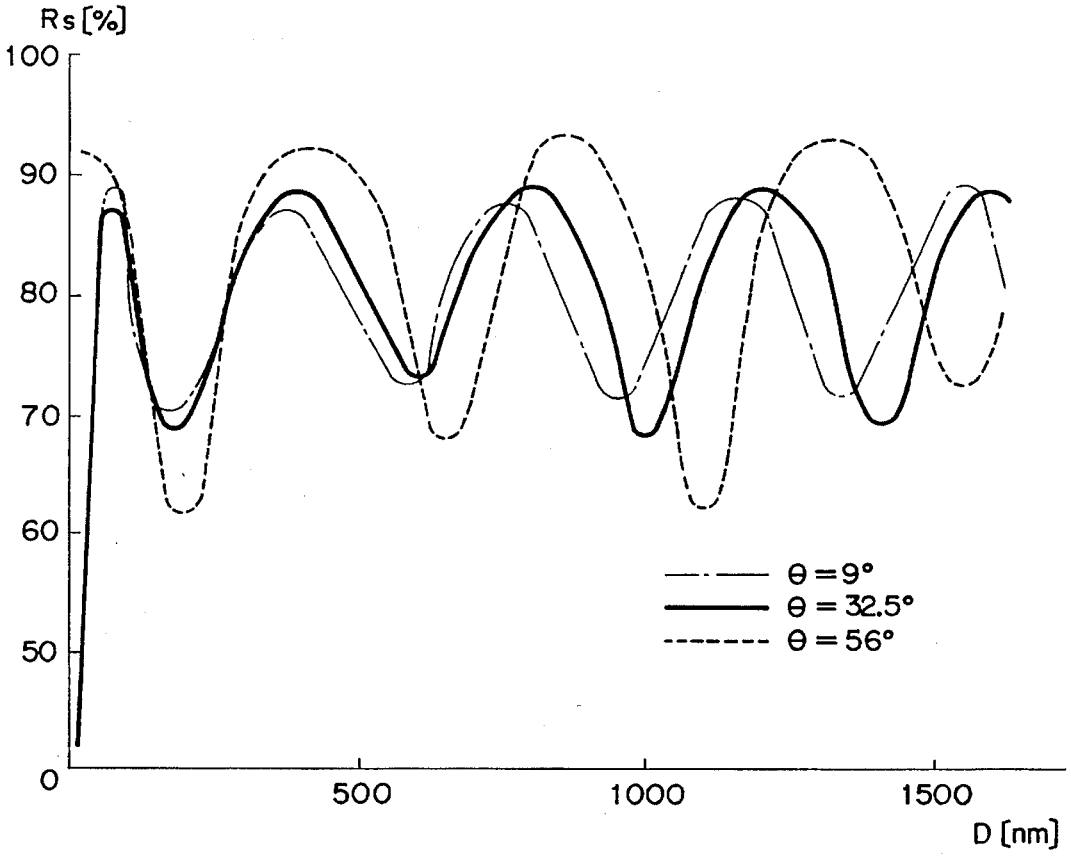
FIG. 6 is a graph representation showing the variation of the reflectance with respect to the film thickness in a specular protective film.

One example of the dependence of reflectance for the S polarized light component upon the film thickness of a specular protective film formed in the above manner is shown in FIG. 6. FIG. 6 shows the variation of reflectance with respect to the film thickness of the specular protective film, with the angle of incidence given in three ways of 9°, 32.5° and 56°.

As can be clearly seen from FIG. 6, when the reflectance at a center of the scan range with an angle of incidence (32.5°) of the incident light is at maximum, the reflectance dependence upon the angle of incidence is not minimum. In FIG. 6, the optimal values for the film thickness are considered to be four values of 162 nm, 295 nm, 590 nm and 780 nm.

As this embodiment is constructed as above described, it can exhibit the following advantages:

(1) Since the film thickness corresponding to a desired reflectance is obtained from the relation between a premeasured film thickness of anodic oxide film and the reflectance, and the anodic oxidation treatment is performed by conducting the cumulative charge corresponding to that film thickness, the specular protective film having a constant thickness can be always formed having such a desired reflectance, and the specular part will have a minimum variation in the intensity of reflected light with the angle of incidence of the incident light.

(2) When the specular protective film is formed simultaneously for a plurality of specular parts, the charge applied to each specular part is sampled at a predetermined interval and controlled to be equal to the average value of all the sampled values, whereby the specular protective film formed on the plurality of specular parts will have an equal thickness, and the reflectance of each specular part will be even.

(3) Since the anodic oxidation takes place only on the specular part by shielding the anode from the cathode during the anodic oxidation treatment, no anodic oxide film is formed on the anode, whereby the anode will have a more improved durability. Further, the anode and the specular part are placed into electrical contact more firmly by pressing the anode against the specular part, whereby the reliability of anodic oxidation treatment can be improved.

Next, the second embodiment of the present invention will be described below with reference to the drawings.

Figure 7:
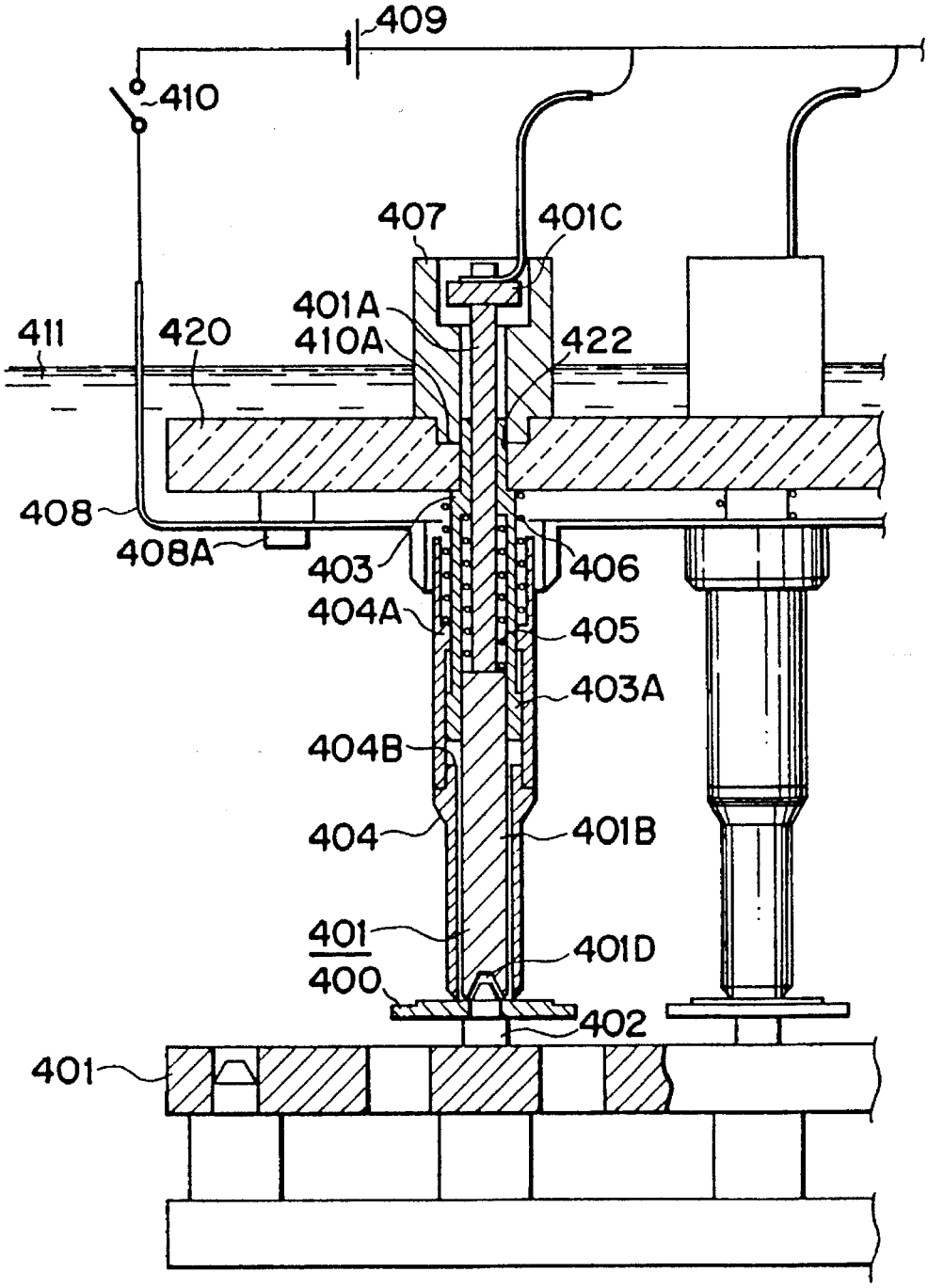
FIG. 7 is a view illustrating another embodiment.

FIG. 7 is a cross-sectional view illustrating an example of the apparatus for anodic oxidation treatment.

The apparatus for anodic oxidation treatment according to this embodiment is to form an anodic oxide film as a specular protective film onto a workpiece 400 which is a polygon reflecting mirror made of aluminum.

The workpiece 400 is a polygon reflecting mirror of hexagonal prism, with its six lateral faces used as the reflecting face for polarizing a laser beam for use with a laser printer or a laser copying machine. Also, the workpiece 400 is formed with a mounting hole 400A for mounting to the printer or copying machine in its axial direction. The workpiece 400 is mounted on a workpiece support base 401 by inserting the mounting hole 400A onto a workpiece support member 402 protruded on the workpiece support base 401 at a predetermined spacing, and can be securely pressed by an anode 401 having electrode pressing means as described later. In this state, the workpieces 400 are immersed into an electrolyte 411, along with anodes 401 and cathodes 408 attached to the electrode support base 400, whereby an anodic oxide film is formed thereon by applying charge between the anode 401 and the cathode 408.

The anode 401 attached to the electrode support base 420 will be now described.

The electrode support base 400 is formed with anode electrode mounting holes 422 at a predetermined spacing, corresponding to workpiece support members 402 on the workpiece support base 401.

In the anode electrode mounting hole 422 is secured a cylindrical anode support member 403 inserted slidably in a predetermined width into a first shield member 404 which is a cylindrical electrode shield member as will be described later. Thereby, the first shield member 404 is slidable in a predetermined width with respect to the anode electrode support member 403. The anode electrode support member 403 is provided with a fitting portion having a small diameter, whereby the anode electrode support member 403 is secured to the electrode support base 400 by fitting the fitting portion into the anode electrode mounting hole 422 from the lower side of the electrode support base 400. Also, a locking portion 403A for restricting the sliding range of the first shield member 404 in the axial direction is provided on the outer periphery near the lower end of the anode electrode support member 403.

In an upper opening portion of the anode electrode mounting hole 422 on the electrode support base 420, a fixing recess portion 410A for the second shield member 407 to shield the anode 401 from the cathode electrochemically is formed. Into the fixing recess portion 410A is fitted a cylindrical second shield member 407 having an inner cylindrical diameter equal to an outer diameter of the fitting portion of the anode electrode support member 403. Also, the second shield member 407 is formed with an inner cylindrical larger diameter portion for restricting the sliding range of the anode 401 downward in the axial direction.

The anode 401 is of a columnar shape, and has a contact portion 401B having a diameter equal to an inner diameter of the anode electrode support member 403, and an axis support portion 401A having a diameter equal to an inner diameter of the fitting portion of the anode electrode support member 403. The anode 401 is inserted slidably in a predetermined width into a through hole passing from the anode electrode support member 403 to the second shield member 407. Further, an electrode pressing spring means 405 is interposed between the anode 401 and the anode electrode support member 403 to bias the anode 401 downward in the axial direction which is a direction against the electrode support base.

At an upper end portion of the axis support portion 401A of the anode 401, an electrode stopper 401C is mounted to restrict the sliding range of the anode 401 downward in the axial direction. Then, the electrode pressing spring 405 lies between a lower end of the fitting portion of the anode electrode support member 403 and the contact portion 401B of the anode 401, the anode 401 being always biased downward by a spring force of the electrode pressing spring 405. If the anode 401 is biased upward against the spring force, the anode 401 is slidable until its contact portion 401B abuts against the lower end of the fitting portion of the anode electrode support member 403. Also, at a top end of the contact portion 401B of the anode 401, a concave portion 401D is formed into which a projecting end of the work support member 402 on the work support base 401 is fitted. On the other hand, a shield pressing spring 406 is interposed between the first shield member 404 and the anode electrode support member 403 to always bias the first shield member 404 downward in the axial direction which is a direction against the electrode support base.

The first shield member 404 is formed with a first shield stopper portion 404A for restricting the downward sliding range of the first shield member 404 which is also used as a locking portion for the shield pressing spring 406, and a second shield stopper portion 404B for restricting the upward sliding range of the first shield member 404. Thereby, the shield pressing spring 406 always biases the first shield member 404 downward between the first shield stopper portion 404A and the electrode support base 400. The inner diameter of the first shield stopper portion 404A is equal to the outer diameter of the anode electrode support member 403, and the inner diameter of the second shield stopper portion 404B is substantially equal to the diameter of the contact portion 401B of the anode 401, whereby as the first and second shield stopper portions 404A, 404B abut against the locking portion 403A provided on the outer peripheral portion of the anode electrode support member 403, the sliding range of the first shield member 404 can be restricted. In this embodiment, the electrode pressing spring 405 is formed having a stronger spring force than the shield pressing spring 406.

The anode 401 is biased by the electrode pressing spring 405, whereby the electrode stopper 401C is always placed into abutment with a bottom face of a large diameter portion of the second shield member 407. Also, the first shield member 404 is biased by the shield pressing spring 406, whereby the first shield stopper portion 404A is always placed into abutment with the locking portion 403A of the anode electrode support member 403. Then, the anode 401 is located more downward at its top end than the first shield member 404.

The first shield member 404 and the second shield member 407 are formed of polyvinyl chloride (PVC) rubber and polytetrafluoroethylene (Teflon), for example.

On the other hand, the cathode 408 is a plate-like electric conductor attached by means of a plurality of mounting jigs 408A positioned a predetermined spacing away from the bottom face of the electrode support base 400, with an aperture provided on a mounting portion of the anode 401. The anode 401 and the cathode 408 are connected to a power source 409, which is switched on/off by operating the switch 410.

In this embodiment, the workpiece 400 in a state of being mounted on the workpiece support base 401 is conveyed to a predetermined position corresponding to the anode 401 with a conveying apparatus (not shown) to be immersed into an electrolyte 411, after a cleaning process for the work 400. In this state, in order to securely press the workpiece 400 with the anode 401, the electrode support base 420 is lowered by an electrode drive apparatus (not shown).

The immersion depth of the workpiece 400 is such that an upper end portion of the anode 401 which is a connecting portion with the power source 409 may not be immersed into the electrolyte 411, when the electrode support base 400 is moved downward to securely press the work 400 with the anode 401.

Lowering the electrode support base 420, a top end of the first shield member 404 first abuts on the workpiece 400, and subsequently a top end of the anode 401 abuts on the workpiece 400. Then, the anode 401 is placed in a state in which a projecting end portion of the workpiece support member 402 on the workpiece support base 401 is fitted into its concave portion 401D, and in contact with the workpiece 400 on the periphery of the concave portion 401D.

Further, lowering the electrode support base, the anode 401 and the first shield member 404 are placed in a state in which the workpiece 400 is pressed with spring forces of the electrode pressing spring 405 and the shield pressing spring 406 against the workpiece support base 401 fixed therein.

In this state, the workpiece 400 is securely pressed, whereby the setting of the workpiece 400 on the apparatus for anodic oxidation treatment has been completed. Subsequently, the power source 409 is turned on by manupulating the switch 410 to apply charge between the anode 401 and the cathode 408, so that an anodic oxide film is formed on the surface of the workpiece 400 by anodic oxidation.

Since the anode 401 is inserted into cylindrical first and second shield members 404, 407 and shielded electrochemically from the cathode 408 in this embodiment, the workpiece 400 acts substantially as an anode in forming the anodic oxide film, so that the oxide film is only formed on the surface of the workpiece 400.

Accordingly, the anode 401 can be consecutively reused without its surface subjected to the oxidation. Also, the anode 401 is placed in a state of pressing the workpiece 400 with a spring force of the electrode pressing spring 405, so that the anode 401 is firmly brought into contact with the workpiece 400.

When the formation of anodic oxide film is completed, the pressing state of the workpiece 400 can be released by raising the electrode support base 420 after turning the power source 409 off by manupulating the switch 410.

In the above embodiment, the operation of securely pressing the workpiece 400 with the anode 401 and the first shield member 404 is performed in the electrolyte 411, but that operation can be performed outside the electrolyte 411. In this case, the same operation as previously described is performed outside the electrolyte 411 to securely press the workpiece, and then the electrode support base 420 and the workpiece support base 401 are lowered into the electrolyte 411 at the same time, to thereby immerse the workpiece 400 into the electrolyte 411, along with the anode 401 and the cathode 408, whereby the anodic oxidation process can be also performed in the similar way.

As this embodiment is constructed in the above described manner, it can exhibit the following advantages.

(1) With a method for anodic oxidation treatment according to the present invention, the workpiece in contact with the anode acts substantially as an anode for the cathode by shielding electrochemically the anode from the cathode, whereby the anodic oxidation takes place on the workpiece, forming an oxide film only on the workpiece.

(2) Since the oxide film is not formed on the anode, the process for removing the oxide film is unnecessary, resulting in a simplified and more efficient operation. Since the durability of the anode is also improved, this embodiment is economically advantageous.

(3) Since the anode is pressed against the workpiece to firmly make contact therewith, the electrical contact failure or drop of the workpiece can be prevented, thereby contributing to the improvement in the reliability as well as the operation efficiency.

(4) With the apparatus for anodic oxidation treatment according to the present invention, the anode is electrochemically shielded from the cathode, so that the formation of oxide film on the anode can be prevented. Since the anode is pressed against the workpiece by the electrode pressing means, the workpiece and the anode can be fimly contacted.

What is claimed is:

1. A method of forming an anodic oxidation film on a plurality of workpieces in apparatus comprising switch means for switching current to flow to each workpiece, detection means for detecting a current flowing to each workpiece, first control means for controlling the current flowing to each workpiece, second control means for controlling the switch means and the first control means, and a power source, said method comprising the steps of:

immersing said plurality of workpieces in an anodic oxidation liquid;

applying a constant current to each workpiece;

when the voltage applied by the power source exceeds a preset voltage value, holding the voltage of said power source constant to apply a constant voltage to each workpiece;

comparing an average value of a time integral of current flowing to the workpieces with a preset time integral current value in order to determine whether or not sufficient current to form an oxide film of a desired thickness has flowed to each workpiece;

in response to a determination that the current which has flowed is not sufficient to form an oxide film having the desired thickness on each workpiece, performing the following:

setting a time $T_1$ when the voltage of the power source is less than said preset voltage value, and at the time $T_1$ comparing a value of the current flowing to each workpiece at the set time $T_1$ with a predetermined current range;

stopping the current to each workpiece having a current value which is out of the predetermined current range;

reducing current to the workpieces by a factor n/N where n is the number of workpieces in which the current has been stopped and N is the total number of workpieces; and correcting the current to each workpiece at a time $T_2$ subsequent to time $T_1$ by obtaining the difference between an average value of a time integral of current flowing to the workpieces and a time integral of current flowing to each workpiece.

2. A method according to claim 1, wherein said workpiece is a rotary polygonal mirror.

3. A method according to claim 2, wherein said rotary polygonal mirror is an aluminum alloy with a surface layer including a layer having a complex refractive index, and said anodic oxidation film is formed thereon.

4. A method of forming an anodic oxidation film on a plurality of workpieces in apparatus comprising switch means for switching current to flow to each workpiece, detection means for detecting a current flowing to each workpiece, first control means for controlling the current flowing to each workpiece, second control means for controlling the switch means and the first control means, and a power source, said method comprising the steps of:

immersing said plurality of workpieces in an anodic oxidation liquid;

providing current to each workpiece;

comparing an average value of a time integral of current flowing to the workpieces with a preset time integral current value in order to determine whether or not sufficient current to form an oxide film of a desired thickness has flowed to each workpiece;

in response to a determination that the current which has flowed is not sufficient to form an oxide film having the desired thickness on each workpiece, performing the following:

setting a time $T_1$ when the voltage of the power source is less than a preset voltage, and at the time $T_1$ comparing a value of the current flowing to each workpiece at the set time $T_1$ with a predetermined current range;

stopping the flow of current to any workpiece when the flow of current to the workpiece is out of the predetermined current range in the current comparing step;

decreasing the current flowing to the workpieces for which the flow of current has not been stopped in correspondence to current to the workpiece or workpieces for which the flowing of current has been stopped.

* * * * *

UNITED STATES PATENT AND TRADEMARK OFFICE

CERTIFICATE OF CORRECTION

PATENT NO. : 5,503,730

DATED : April 2, 1996

INVENTORS : NAGATO OSANO ET AL.

It is certified that error appears in the above-identified patent and that said Letters Patent is hereby corrected as shown below:

COLUMN 2

Line 27, "out of" should read --out of an--.

COLUMN 4

Line 4, "conduction" should read --conduction,--.

COLUMN 5

Line 8, "of S" should read --of the S--;
Line 14, "of S" should read --of the S--;
Line 15, "between" should read --between the--;
Line 16, "and" should read --and the--;
Line 26, "Where" should read --where--;
Line 35, "at interface between" should read --at the interface between the--;

UNITED STATES PATENT AND TRADEMARK OFFICE

CERTIFICATE OF CORRECTION

PATENT NO. : 5,503,730 Page 2 of 3

DATED : April 2, 1996

INVENTORS : NAGATO OSANO ET AL.

It is certified that error appears in the above-identified patent and that said Letters Patent is hereby corrected as shown below:

COLUMN 5

Line 36, "and" should read --and the--;
Line 37, "at interface between" should read --at the interface between the---;
Line 38, "and" should read --and the--;
Line 40, "$\cdot r_s$" should read --$\cdot r_{1S}$.--;
Line 44, "Where" should read --where--;
Line 47, "of" should read --of the--;
Line 48, "of" should read --of the--;
Line 49, "of S" should read --of the S--;
Line 51, "of" should read --of the--;
Line 55, "of" should read --of the--.

COLULMN 6

Line 30, "$\Delta$txnumber" should read --$\Delta$t x number--.

UNITED STATES PATENT AND TRADEMARK OFFICE

CERTIFICATE OF CORRECTION

PATENT NO. : 5,503,730 Page 3 of 3

DATED : April 2, 1996

INVENTORS : NAGATO OSANO ET AL.

It is certified that error appears in the above-identified patent and that said Letters Patent is hereby corrected as shown below:

COLUMN 9

Line 17, "top" should read --bottom--;
Line 58, "(PVC)" should read --(PVC),--.

COLUMN 10

Line 13, "work" should read --workpiece--.

Signed and Sealed this

Seventeenth Day of September, 1996

*Attest:*

Bruce Lehman

BRUCE LEHMAN

*Attesting Officer*

*Commissioner of Patents and Trademarks*